US007908776B2

(12) United States Patent
Ng et al.

(10) Patent No.: US 7,908,776 B2
(45) Date of Patent: Mar. 22, 2011

(54) GARMENT CARE SYSTEM

(75) Inventors: Mo Tan Ng, Singapore (SG); Chaithra Belle, Singapore (SG); Hock Soon Tiew, Singapore (SG); Tang Har Pong, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 404 days.

(21) Appl. No.: 12/088,837

(22) PCT Filed: Sep. 15, 2006

(86) PCT No.: PCT/IB2006/053313
§ 371 (c)(1),
(2), (4) Date: Mar. 31, 2008

(87) PCT Pub. No.: WO2007/036828
PCT Pub. Date: Apr. 5, 2007

(65) Prior Publication Data

US 2010/0000130 A1 Jan. 7, 2010

(30) Foreign Application Priority Data

Sep. 29, 2005 (EP) ..... 05109027

(51) Int. Cl.
*D06F 75/12* (2006.01)
*D06F 75/26* (2006.01)

(52) U.S. Cl. ..... 38/77.6; 38/77.83; 219/247

(58) Field of Classification Search ..... 38/74, 75, 38/77.1–77.8, 77.82, 77.9, 82, 85, 88, 96; 219/245–247, 250, 256
See application file for complete search history.

(56) References Cited

U.S. PATENT DOCUMENTS

| | | | | |
|---|---|---|---|---|
| 5,493,799 | A | 2/1996 | Foo | |
| 5,842,295 | A * | 12/1998 | Ching et al. | 38/77.6 |
| 6,061,935 | A * | 5/2000 | Lee | 38/77.6 |
| 6,212,332 | B1 | 4/2001 | Sham | |
| 6,678,973 | B2 * | 1/2004 | de Mori | 38/77.6 |
| 6,711,840 | B1 | 3/2004 | Rosenzweig | |

FOREIGN PATENT DOCUMENTS

| | | |
|---|---|---|
| DE | 202004014412 | 11/2004 |
| EP | 1482084 | 12/2004 |
| JP | 03295596 | 12/1991 |
| JP | 7039697 | 2/1995 |
| WO | 02070812 | 9/2002 |
| WO | 2005054564 | 6/2005 |

* cited by examiner

*Primary Examiner* — Ismael Izaguirre
(74) *Attorney, Agent, or Firm* — Sherry Womak

(57) ABSTRACT

A garment care system includes a steam generator having a steam outlet, and a handset having a steam inlet arranged for coupling to the steam outlet, an opening for releasing steam and a steam control unit for controlling a valve for controlling the release of steam. The steam control unit includes a selector unit having at least two selection options, and a steam release switch connected to the selector unit and arranged for starting or stopping the release of steam in dependence on the selected option.

25 Claims, 4 Drawing Sheets

GARMENT CARE SYSTEM

Figure 1:
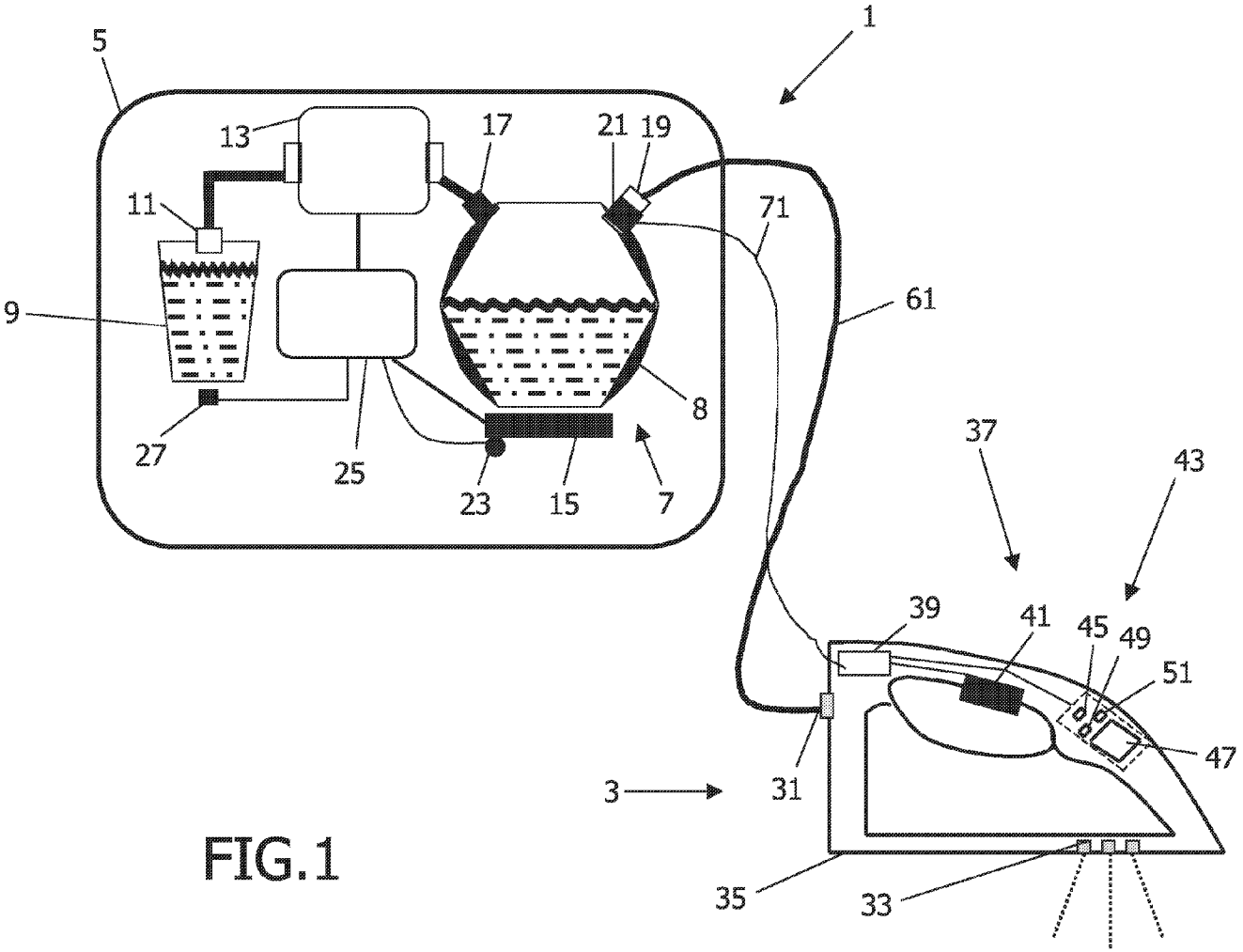

The present invention relates to a garment care system comprising a steam generator having a steam outlet, and at least one garment care handset having a steam inlet arranged for coupling to the steam outlet, an opening for releasing steam and a steam control unit arranged to control a valve for controlling the release of steam. The invention further relates to an iron suitable for cooperation with a steam generator having a steam outlet, a garment steamer suitable for cooperation with a steam generator having a steam outlet and a method of releasing steam from a garment care system.

Such a garment care system is well-known in practice, and is usually designed to be used in combination with, for example, a steam iron, wherein a connection between the steam generator and the iron is realized through a steam hose. An important function of the steam generator system is generating steam and supplying the steam to the iron, wherein the steam iron comprises a soleplate and a steam outlet or outlets arranged in the soleplate for letting out steam to an article to be treated, e.g. ironed, refreshed, or de-wrinkled. During operation of the steam generator, the steam is generated in, for instance, a metal case or a boiler, and the supply of steam to the handset is controlled by means of a steam valve connected to a steam outlet of the boiler. In many steam systems, for the purpose of supplying water to the boiler and pressurizing the water inside the boiler, a pump is arranged. For the sake of completeness, it is noted that the term "valve" is used to indicate a device of which a condition can be adjusted. In an opened condition, the valve is capable of passing a flow of a fluid, a mixture of fluids, steam or a mixture of air and steam. In a closed condition, the valve blocks such a flow.

Alternatively, the steam generator can be connected to a garment steamer to supply steam to the garment steamer. It is well known that garment steamers have been widely used for domestic applications. A garment steamer may be classified as a hand-held steamer and a steamer with a steam station to supply the steam.

The garment care handset, e.g. the steam iron or the garment steamer, may be provided with a steam activator or steam release switch. To get the handset steaming, the user has to press and hold onto the steam activator.

A problem of this type of handheld garment care systems is that the user has to hold onto the steam activator during the whole process of steaming, refreshing or ironing. This may be a tiring experience, especially if the article to be treated has a large surface such as the back of a shirt, a dress, a sheet, a tablecloth, a curtain and the like. Furthermore, there is only one way the user can get the handset to steam. This can in some cases be inflexible, especially if the user wants to iron different articles with different sizes and shapes, e.g. small surface areas and large surface areas.

It is an object of the invention to provide a garment care system that has several application possibilities and is easy to use.

This object is achieved with a garment care system according to the invention, which is characterized in that the steam control unit comprises

- a selection means having at least two selection options, and
- a steam release switch electrically connected to the selection means and arranged for starting or stopping the release of steam in dependence on the selected option.

An embodiment of a garment care system according to the invention provides the user with a means for choosing from at least two options or ways in which steam can be released. The user may select the option that fits best the task at hand. The at least two options provide the user with the flexibility to choose or select the way he/she wants to operate the steam release of the handset. A garment care system according to the invention is more flexible and is easy to use; this way the object of the invention is achieved.

In an embodiment of a garment care system according to the invention, the selection options comprise a first selection option and a second selection option, and the user may select between the at least two options via the selection means.

In the first option, the steam release switch operates like an on-off button, e.g. a steam lock option, or a toggling effect: touch the switch and subsequently the handset steams, touch it again, and it stops steaming. This is less tiring than pushing a steam release switch all the time the user wants steam.

In the second option, the steam release switch functions as an on demand button. As long as it is depressed, the steam is expelled from the opening or openings in the handset. In a garment care system according to the invention the user may select, via the selection means, between at least these two options.

The user may select the option he/she finds most suitable for the task at hand; the user is flexible in the way he/she wants to operate the handset. In case the user wants to iron for instance a large article like a sheet or a tablecloth, the user may prefer to select the first option, or toggle option. This can be done by selecting the first option via the selection means and subsequently pressing the steam release switch once. Now steam will be released until the user decides he/she wants to stop the steam release. At that moment, the user presses the steam release switch again and the steam release stops. The user doesn't have to continuously push a button to have a continuous steam release, and he/she can focus on the ironing process and steering or manoeuvering of the iron itself. In case the user wants to iron a small article or an article that needs to be picked up and moved frequently to a different position like for instance the upper part of a pair of trousers, the second or on demand option may be preferred. This way the steam is off when the steam release switch is not pressed, for instance during placing or replacing the article. This can for instance be the case because the user put the iron on its heel to have his/her hands free to place or replace the article on the ironing board. For stubborn or persistent wrinkles an on demand portion of steam may help to flatten a specific part of the article.

The two options can also be advantageously employed to use a garment steamer for refreshing an article. For refreshing a small article or for instance arm pits of a jacket, the user may prefer the second or on demand option to provide a short burst of steam. For refreshing a large article such as a hanging curtain, the user may prefer the toggle option (or so-called first option). This way the user can simply activate the steamer for as long as he/she prefers without having to press a button, switch or knob.

In an alternative embodiment, the steam control unit may be provided with a third steam release option. An embodiment of the third steam release option may use a decision mechanism such as time. Depending on how long the user presses the steam release switch, the electronic controller in the selection means activates a short or ongoing release of steam. In such an embodiment, a decision unit controls the selection means by detecting or measuring the time that the user presses or touches the steam release switch. Such a decision unit is known per se for instance for the controlling of a car window going up or down.

An embodiment of the third option will now be explained in more detail. If the user would like to use the time-related steam release option, the user first selects the third steam release option and then presses the steam release switch for a certain time. If this time is short, for instance shorter than approximately one second, a short release of steam is provided. If this time is longer, for instance in a range of one to two seconds, continuous steaming starts. In a practical embodiment, continuous steaming stops if the steam release switch is touched again.

In an embodiment of a garment care system according to the invention, the steam release switch is further arranged to control the selection means such that if the steam release switch is pressed and let go in less than x seconds, steam is being released during activation of the steam release switch, and if the steam release switch is pressed and let go in x seconds or more than x seconds, steam is being released continuously until the steam release switch is activated again, x being in a range of 1-5 sec, preferably 1-2 sec.

The third option provides a means such that the user doesn't have to press the selection means to change between short and continuous steaming. This is a layout that a user may find convenient or easier to use.

An embodiment of a method according to the invention comprises the following steps.

First, the user selects the option he/she wants to use by pressing the steam option selection means, e.g. buttons, switches. If the current option is desired no additional selection operation has to be performed, such as pressing a button or a switch. In this case the selection consists merely of ascertaining what the selected or current option is.

Secondly, the user activates the steam release by pressing or pushing the steam release switch. The steam release switch sends a signal to the electronic controller. The electronic controller sends a signal to the valve to open or close depending on the option selected. If the valve is open, steam is released from the steam generator and travels through the hose and the handset towards the at least one opening. This way steam is being expelled from the opening.

In an embodiment of a garment care system according to the invention, multiple handsets can be coupled to the steam generator. Such means are known per se. This way the user only needs one steam generator and can use this for multiple purposes, e.g. ironing an article using the iron and steaming an article to reduce wrinkles, refresh it using the garment steamer etc. Instead of having two complete garment care systems, the user only needs one steam generator with accessories such as the iron or the garment steamer; this requires less space and is more economical because fewer pieces are needed. Also in the case of defects or new types of handsets, the user can simply connect the new handset to the existing steam generator.

The user input to select a steam release option is made via the selection means: This may for instance comprise a menu on a touch screen or a set of buttons, each button being associated with a different option. Alternatively the selection means comprises one button arranged for toggling between two options or a slide slidable between at least two positions.

In a preferred embodiment, the selection means comprises a button that is electronically connected to a display for providing information on the option selected, and an electronic controller coupled to the steam release switch and the valve.

A steam release switch of a garment system according to the invention may be a press button, a touch-sensitive button or touch-sensitive area, a control or an activator that may be operated by touching, pressing, depressing, pulling or pushing, or any other suitable means. Alternatively the steam release switch may be an array of light-emitting diodes (LED) functioning as a touch-sensitive button. The intensity and or color of the LED light may vary depending on the option selected. This provides the user with direct feedback about the action to be expected after activation of the steam release button and thus reduces the risk of errors or unexpected behaviour, which might be annoying or create a risk of harming the article. The skilled person can select any suitable type of switch.

In an embodiment of the handset of the garment care system according to the invention, the steam release switch has a rest position, or starting position, which position is the same after every activation by the user. Examples of steam release switches in a rest position may be an extended button or a slide located at a dedicated side of a slit. After activation of the steam release switch, a spring means coupled to the switch pushes or pulls the switch back into the rest position.

In another embodiment of a garment care system according to the invention, the steam release switch is a button having an extended button position and a retracted button position, the button being coupled to a spring means arranged for putting the button in the extended button position after activation of the button. In the embodiment, a display to provide visual information about the option selected is also present. The rest position provides a neutral starting position at every new activation by the user. This way the action of the steam release switch is only indicated by the display; this limits the risk of confusion for the user about what the action of the steam release switch will be after activating, pressing or triggering it. This is especially beneficial if multiple steam release options are possible.

The opening or openings are preferably located in the sole of the iron or in the mouth of the garment steamer.

A skilled person knows how to manufacture an electronic scheme capable of providing this functionality either by conventional electronics or for instance a microprocessor.

In an embodiment of a garment system according to the invention, the valve is located at a position between the opening for releasing steam and the immediate vicinity of the steam outlet. The immediate vicinity may be inside or outside the steam generator. The valve may be located in front of, behind or inside the steam outlet.

Alternatively, the valve may be located in a housing of the steam iron or in a body of the garment steamer. In an embodiment of a garment care system according to the invention, a solenoid valve may be used. A solenoid valve uses a solenoid to control valve activation. A solenoid comprises a wire coil and a movable plunger that seats against the coil. When current is applied to the coil, an actuating magnetic field is created. Solenoids are frequently used as switches or controls for mechanical devices, such as valves. Solenoid valves are electromechanical devices that use a solenoid to control valve actuation. Electrical current is supplied to the solenoid coil, and the resulting magnetic field acts upon the plunger, whose resulting motion actuates the valve. Standard models are available in both AC and DC voltages. Another specific characteristic of solenoid valves is whether their normal operating state is open, or closed, when not energized.

In a practical embodiment, the selection means and the steam release switch are located in such a way that the user may use all options with the hand holding the handset; the selection means and the steam release are both within reach of at least one of the fingers while the handset is being held. For instance both can be reached using an index finger. Or, alternatively, the selection means can be reached using the index finger and the steam release switch can be reached using the thumb or vice versa. In this way, using such a handset, the user may easily switch between different steam release options without having to put the handset, e.g. iron, down or use the other hand.

In an embodiment of a garment care system according to the invention, the system comprises a support unit arranged for supporting the iron housing(?) the steam generator. This support unit may be a stand having a platform, a case having a deck comprising an iron rest, an ironing board having a platform; this platform may be a cloth of an ironing board. A skilled person is not limited to these examples. A steam generator housed by a support system having a rest position for the handset makes the system more compact and fewer separate accessories or space is needed.

In an embodiment of a garment care system according to the invention, the system comprises a water tank having a tank outlet, a pump arranged to pump water from the tank outlet to an inlet of the steam generator. This way the garment system according to the invention can function as a complete system and the user does not depend on separate steam generating means.

The invention also comprises any possible combination of features or subject matter as claimed in any one of the claims.

It has to be noted that in a known steam iron, the steaming process starts when the iron is oriented with the soleplate in a substantially horizontal position. In such a steaming iron, steaming stops when the soleplate is placed or oriented in a substantially vertical position, for instance on its heel. In such a steam iron the user tilts the iron to start or stop steam release without pushing a button. This steam iron comprises one option for steam release: orienting the soleplate in a substantially horizontal position.

Figure 2:
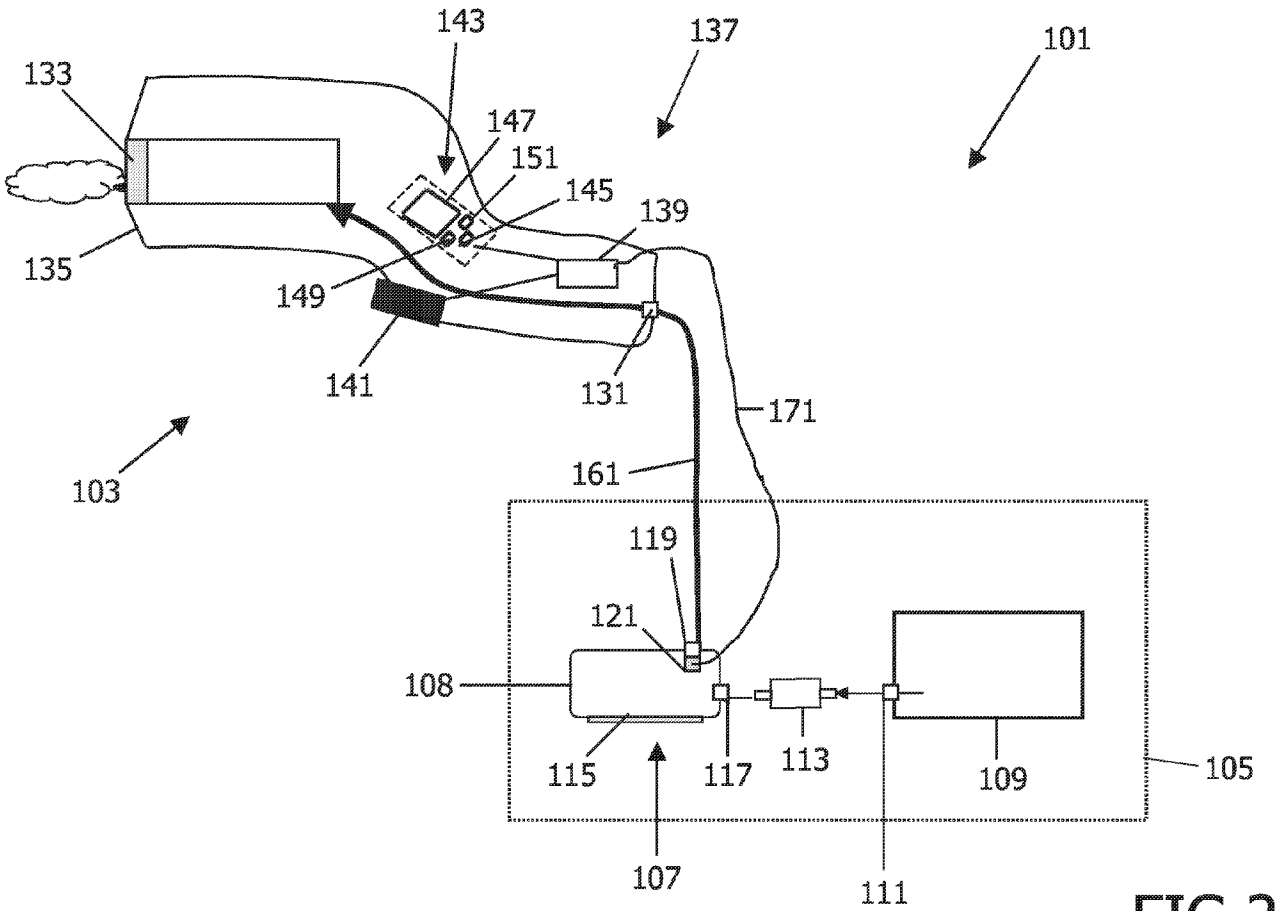
Figure 3:
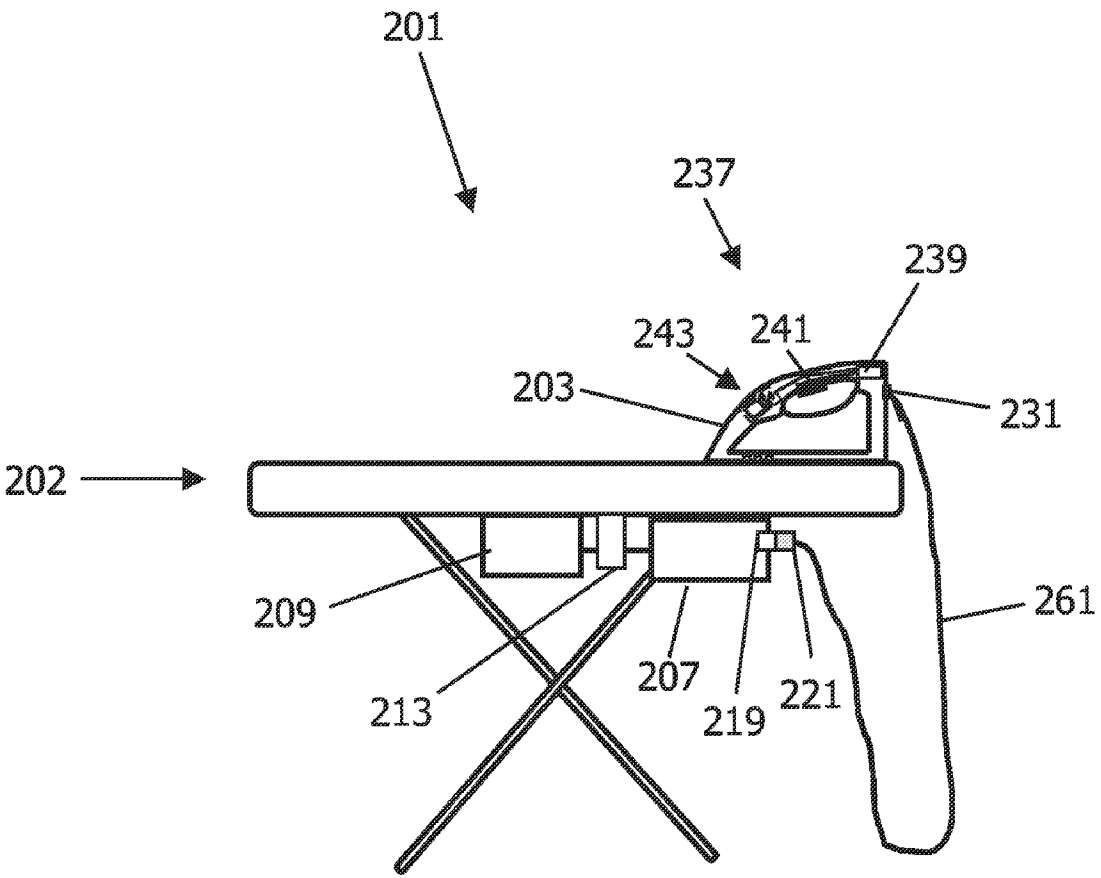
Figure 4:
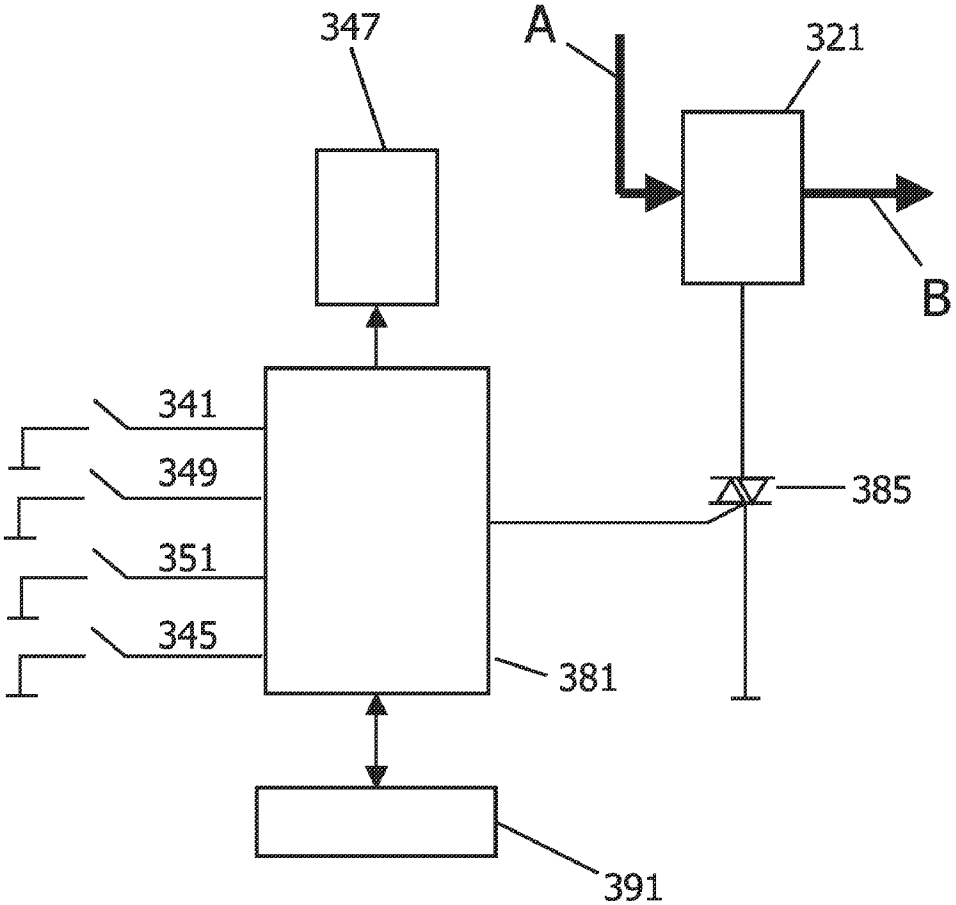

The invention will now be exemplarily described with reference to the accompanying drawings. In principle all aspects can be combined. In the Figures the same numbers are used for the same or equivalent features, in which:

FIG. 1 schematically depicts a first embodiment of a garment care system according to the invention in which the handset is an iron, FIG. 2 schematically depicts a second embodiment of a garment care system according to the invention in which the handset is a garment steamer, FIG. 3 schematically depicts a third embodiment of a garment care system according to the invention in which the support unit is an ironing board, FIG. 4 diagrammatically depicts a block diagram of an embodiment of a steam control unit according to the invention.

The Figures are now described in detail and reference is being made to the numbers in the Figures.

In FIG. 1, a first embodiment of a garment care system 1 according to the invention is depicted in which the handset is an iron 3. A stand 5 comprises a steam generator or boiler 7, a water tank 9 having a water outlet 11 and a tank switch 27, an electrical pump 13 and an electronics controller 25. The steam generator comprises a chamber 8, a water inlet 17 and a steam outlet 19 and is equipped with an electronically controlled valve 21, e.g. a solenoid valve, a temperature or pressure sensor 23 and a heating element 15 secured to the chamber.

The iron comprises a steam inlet 31, multiple openings 33 located in a soleplate 35 and a steam control unit 37. The steam control unit comprises an electronic controller 39 being electronically connected to a steam release switch 41 and to a selection means 43. The selection means comprises a steam option selection switch or button 45, an Up selection button 49 and a Down selection button 51 and a visual display 47. The steam control unit 37 will be explained in detail with reference to FIG. 4.

The iron may further comprise a temperature selection switch (not shown) and a steam rate selection switch (not shown) arranged for selecting the desired temperature and steam rate, respectively.

The visual display 47 may comprise a LCD module providing visual feedback and, in combination with the switches, allows the selection of a menu function or settings.

A hose 61 is arranged at one end for coupling to the steam outlet 19 and at the other end for coupling to the steam inlet 31. The electronic controller 39 and the valve 21 are electrically interconnected by means of a wire 71.

In FIG. 2 the second embodiment of a garment care system 101 according to the invention is depicted in which the handset is a garment steamer 103. A steam station 105 comprises a steam generator or boiler 107, a water reservoir 109 having a water outlet 111 and an electrical pump 113. The steam generator 107 comprises a chamber 108, a water inlet 117 and a steam outlet 119 and is equipped with a valve 121 and a heating element 115 secured to the chamber.

The garment steamer comprises a steam inlet 131, an opening 133 located in the mouth 135 and a steam control unit 137. The steam control unit comprises an electronic controller 139 being electronically connected to a steam release switch 141 and to a selection means 143. The selection means comprises a steam option selection switch or button 145, an Up selection button 149 and a Down selection button 151 and a visual display 147. The steam control unit 137 will be explained in detail with reference to FIG. 4.

The visual display 147 may comprise a LCD module providing visual feedback and, in combination with the switches, allows the selection of a menu function or settings.

A hose 161 is arranged at one end for coupling to the steam outlet 117 and at the other end for coupling to the steam inlet 131. The electronic controller 139 and the valve 121 are electrically interconnected by means of a wire 171.

FIG. 3 schematically depicts a third embodiment of a garment care system 201 according to the invention. The system comprises an ironing board 202 as a support unit and an iron 203 according to the invention. The iron in FIG. 3 is the same iron as in FIG. 1. The iron 203 according to the invention comprises a steam inlet 231, an opening located in the sole and a steam control unit 237. The steam control unit comprises an electronic controller 239 being electronically connected to a steam release switch 241 and to a selection means 243. The selection means comprises a steam option selection switch or button, an Up selection button and a Down selection button and a visual display. The steam control unit 237 will be explained in detail with reference to FIG. 4. The ironing board houses a water tank 209, a pump 213 and a boiler 207 comprising an outlet 219 and a valve 221. The pump is arranged for pumping water from the water tank to the boiler. A hose 261 interconnects the valve 211 and the iron 203. The electronic controller 239 and the valve 231 are electrically interconnected by means of a wire (not shown).

FIG. 4 shows a simplified schematic diagram of an electronic circuit that provides the steam control unit (37, 137, 237) according to the invention. All embodiments shown in FIGS. 1-3 comprise the steam control unit depicted in FIG. 4.

The electronic circuit is based on a micro-controller unit (MCU) 381 with switches (tact switches or push-button switches) as the input devices, an internal or external erasable read/write memory device (e.g. EEPROM) 391, and a LCD display 347, preferably alpha-numeric which can display text as well as graphic symbols. A triac 385 acts as an ON/OFF switch controlling an electro-valve 321 that supplies or cuts off the steam generated by a boiler (not shown). The steam input to the electro-valve 321 is indicated by an arrow A and the steam output from the electro-valve is indicated by arrow B. The firmware of the MCU circuit may provide several 'usage options' to the user, and the options may be viewed and selected via 3 switches (SW): SW-Up 349, SW-Down 351, SW-Menu 345 and the LCD panel 347 as the feedback. One example of the 'Menu Options' may be the choice of the display language (English, Dutch, German, etc), the other may be the choice of the steam option (e.g. steam lock or steam on demand).

In an embodiment of the garment care system according to the invention, the handset comprises a menu-button 345, an Up-button 349, a Down-button 351 and a SW-steam button 341 functioning as steam release switch that may be operated as follows. By pressing the SW-Menu button 345, the firmware enters into the "Menu" mode, and the user may select different options using the SW-Up 349 or the SW-Down 351 button, much like the menu setting function in a cellular phone. Upon reaching a desired option, the user just has to press the SW-Menu button 345 again to confirm his/her selection. The selection will then be stored in the memory device 391, and will be preserved as long as no new options are being selected.

The steam lock toggling option will be explained next. Upon pressing the SW-Menu button 345, the LCD 347 will display a graphic or a string of text, e.g. "Steam Lock On?" or a suitable graphic symbol representing the steaming operation. If the user chooses this feature, he/she has to press the SW-Menu button 345 again and the LCD 347 will then display "Steam Lock On—Confirmed". These actions will then configure the circuit to work in the steam lock "Toggling ON" mode. When the SW-Steam button 341 is pressed, the MCU 381 will turn on the triac 385 which in turn switches on the electro-valve 321, giving a continuous steam output B. So long as the SW-Steam 341 is not pressed again, the steam output will continue. To turn off the steam, simply press the SW-Steam button 341 again and the circuit will 'toggle' the steam lock state to OFF, turning off the triac 385 and electro-valve 321, and cutting off the steam output B.

The first option, e.g. steam lock or toggle option, allows the user to start the steam release with a single activation of the steam release switch 341; after that the user can iron without having to bother about keeping the steam release button 341 activated, for instance by pressing it. The user can thus focus his/her attention on the article that is to be ironed. Analogously, the user can use a garment steamer without having to press down a button. In a practical embodiment, the first option works like a toggling effect; when the trigger is pressed, steaming starts and will continue even when releasing the trigger. Upon the next pressing of the trigger, the steaming stops. Depending on the task at hand, the user can select the option he/she prefers.

The steam 'On Demand' mode refers to a state where steam output is enabled (i.e. triac 385 and electro-valve 321 turn ON) only when the SW-Steam button 341 is depressed continuously; when the SW-Steam button is released, the steam output B will be cut off immediately. To choose this option, press the SW-Menu button 345 and the LCD 347 will display the same string of text which reads "Steam Lock ON?"; by pressing the SW-Down button 351, a new string of text which reads "Steam Lock OFF?" will be displayed and the user can choose this option by pressing the SW-Menu button 345. Following this, the LCD will display "Steam Lock Off—Confirmed" and the circuit is now configured to work in the steam "On Demand" mode

The invention claimed is:

1. A garment care system comprising:

a steam generator having a steam outlet; and at least one garment care handset having a steam inlet arranged for coupling to the steam outlet, an opening for release of steam, and a steam control unit arranged to control a valve for controlling the release of the steam;

wherein the steam control unit comprises:

a selection unit having at least two selection options, and a steam release switch electrically connected to the selection unit and arranged for starting or stopping the release of the steam in dependence on the selected option, and wherein the two options comprise:

a first selection option arranged for starting continuous release of the steam upon a first activation of the steam release switch and for stopping the continuous release of the steam upon a second activation of the steam release switch, and a second selection option arranged for the release of the steam during activation of the steam release switch.

2. The garment care system as claimed in claim 1, wherein the garment care handset is an iron.

3. The garment care system as claimed in claim 2, further comprising a support unit arranged for supporting the iron, and wherein said garment care system is arranged for housing the steam generator.

4. The garment care system as claimed in claim 1, wherein the garment care handset is a garment steamer.

5. The garment care system as claimed in claim 1, wherein the selection unit and the steam release switch are located on the handset in such a way that a user may operate the two options with a hand holding the handset.

6. The garment care system as claimed in claim 1, wherein the steam release switch is arranged to resume a rest position after activation.

7. The garment care system as claimed in claim 1, wherein the steam control unit comprises a display for visual feedback relating to the selected option.

8. The garment care system as claimed in claim 1, wherein the valve is located at a position between the opening for releasing steam and the immediate vicinity of the steam outlet.

9. The garment care system as claimed in claim 1, further comprising a water tank having a tank outlet, and a pump arranged to pump water from the tank outlet to an inlet of the steam generator.

10. A garment care system comprising:

a steam generator having a steam outlet; and at least one garment care handset having a steam inlet arranged for coupling to the steam outlet, an opening for release of steam, and a steam control unit arranged to control a valve for controlling the release of the steam;

wherein the steam control unit comprises:

a selection unit having at least two selection options, and a steam release switch electrically connected to the selection unit and arranged for starting or stopping the release of the steam in dependence on the selected option, and wherein the steam release switch is further arranged to control the selection unit such that if the steam release switch is pressed and let go in less than x seconds, the steam is being released during activation of the steam release switch, and if the steam release switch is pressed and let go in x seconds or more than x seconds, the steam is being released continuously until the steam release switch is activated again, x being a predetermined number.

11. The garment care system as claimed in claim 10, wherein x is in a range of 1-2 sec.

12. A garment care system comprising:

a steam generator having a steam outlet; and at least one garment care handset having a steam inlet arranged for coupling to the steam outlet, an opening for release of steam, and a steam control unit arranged to control a valve for controlling the release of the steam;

wherein the steam control unit comprises:

a selection unit having at least two selection options, and a steam release switch electrically connected to the selection unit and arranged for starting or stopping the release of the steam in dependence on the selected option, wherein the steam release switch is arranged to resume a rest position after activation, and wherein the steam release switch is a button having an extended button position and a retracted button position, the button being coupled to a spring arranged for putting the button in the extended button position after activation of the button.

13. An iron suitable for cooperation with a steam generator having a steam outlet, the iron comprising:

a steam inlet arranged for coupling to the steam outlet;

an opening for release of steam; and a steam control unit arranged to control a valve for controlling the release of the steam, wherein the steam control unit comprises:

a selection unit having at least two selection options, an a steam release switch electrically connected to the selection unit and arranged for starting or stopping the release of the steam in dependence on the selected option, and wherein the two options comprise:

a first selection option arranged for starting continuous release of the steam upon a first activation of the steam release switch and for stopping the continuous release of the steam upon a second activation of the steam release switch, and a second selection option arranged for the release of the steam during activation of the steam release switch.

14. The iron as claimed in claim 13, wherein the steam release switch is arranged to resume a rest position after activation.

15. The iron as claimed in claim 13, wherein the steam control unit comprises a display for visual feedback relating to the selected option.

16. The garment steamer as claimed in claim 13, wherein the steam release switch is arranged to resume a rest position after activation.

17. The garment steamer as claimed in claim 13, wherein the steam control unit comprises a display for visual feedback relating to the selected option.

18. An iron suitable for cooperation with a steam generator having a steam outlet, the iron comprising:

a steam inlet arranged for coupling to the steam outlet;

an opening for release of steam; and a steam control unit arranged to control a valve for controlling the release of the steam, wherein the steam control unit comprises:

a selection unit having at least two selection options, and a steam release switch electrically connected to the selection unit and arranged for starting or stopping the release of the steam in dependence on the selected option, and wherein the steam release switch is further arranged to control the selection unit such that if the steam release switch is pressed and let go in less than x seconds, the steam is being released during activation of the steam release switch, and if the steam release switch is pressed and let go in x seconds or more than x seconds, the steam is being released continuously until the steam release switch is activated again, x being a predetermined number.

19. The iron as claimed in claim 18, wherein x is in a range of 1-2 sec.

20. An iron suitable for cooperation with a steam generator having a steam outlet, the iron comprising:

a steam inlet arranged for coupling to the steam outlet, an opening for release of steam; and a steam control unit arranged to control a valve for controlling the release of the steam, wherein the steam control unit comprises:

a selection unit having at least two selection options, and a steam release switch electrically connected to the selection unit and arranged for starting or stopping the release of the steam in dependence on the selected option, wherein the steam release switch is arranged to resume a rest position after activation and wherein the steam release switch is a button having an extended button position and a retracted button position, the button being coupled to a spring arranged for putting the button in the extended button position after activation of the button.

21. A garment steamer suitable for cooperation with a steam generator having a steam outlet, the garment steamer comprising:

a steam inlet arranged for coupling to the steam outlet an opening for releasing steam, and a steam control unit arranged to control a valve for controlling the release of steam, wherein the steam control unit comprises:

a selection means having at least two selection options, and a steam release switch electrically connected to the selection means and arranged for starting or stopping the release of steam in dependence on the selected option, and wherein the two selection options comprise:

a first selection option arranged for starting the continuous release of steam upon a first activation of the steam release switch and for stopping the continuous release of steam upon a second activation of the steam release switch, and a second selection option arranged for the release of steam during activation of the steam release switch.

22. A garment steamer suitable for cooperation with a steam generator having a steam outlet, the garment steamer comprising:

a steam inlet arranged for coupling to the steam outlet an opening for releasing steam, and a steam control unit arranged to control a valve for controlling the release of steam, wherein the steam control unit comprises:

a selection means having at least two selection options, and a steam release switch electrically connected to the selection means and arranged for starting or stopping the release of steam in dependence on the selected option, and wherein the steam release switch is further arranged to control the selection means such that if the steam release switch is pressed and let go in less than x seconds, steam is being released during activation of the steam release switch and if the steam release switch is pressed and let go in x seconds or more than x seconds, steam is being released continuously until the steam release switch is activated again, x being a predetermined number.

23. The garment care system as claimed in claim 22, wherein x is in a range of 1-2 sec.

24. The garment steamer suitable for cooperation with a steam generator having a steam outlet, the garment steamer comprising:

a steam inlet arranged for coupling to the steam outlet an opening for releasing steam, and a steam control unit arranged to control a valve for controlling the release of steam, wherein the steam control unit comprises:

a selection means having at least two selection options, and a steam release switch electrically connected to the selection means and arranged for starting or stopping the release of steam in dependence on the selected option, wherein the steam release switch is arranged to resume a rest position after activation, and wherein the steam release switch is a button having an extended button position and a retracted button position, the button being coupled to a spring arranged for putting the button in the extended button position after activation of the button.

25. A method for releasing steam from a garment care system, the method comprising the acts of:

generating steam by a steam generator;

controlling release of the steam using a selection unit having at least two selection options, and a steam release switch electrically connected to the selection unit and arranged for starting or stopping the release of the steam in dependence on the selected option, selecting one of the at least two selection options using the selections unit; and activating the steam release switch;

wherein the two options comprise:

a first selection option arranged for starting continuous release of the steam upon a first activation of the steam release switch and for stopping the continuous release of the steam upon a second activation of the steam release switch, and a second selection option arranged for the release of the steam during activation of the steam release switch.

* * * * *